United States Patent [19]

Starr

[11] 4,088,005

[45] May 9, 1978

[54] COMBINED ROTARY PROGRESSIVE DIE

[75] Inventor: Frank Starr, Menomonee Falls, Wis.

[73] Assignee: Koller Die and Tool Co., Milwaukee, Wis.

[21] Appl. No.: 801,753

[22] Filed: May 31, 1977

[51] Int. Cl.[2] ..... B21D 43/05

[52] U.S. Cl. ..... 72/404; 29/38 C; 74/814; 74/826

[58] Field of Search ..... 72/404, 405, 306; 29/792, 33 Q, 38 C, 564; 83/411 R; 74/813 R, 814, 826

[56] References Cited

U.S. PATENT DOCUMENTS

| | | | |
|---|---|---|---|
| 1,817,462 | 8/1931 | Phelps | 29/38 C |
| 2,282,959 | 5/1942 | Gibbs | 72/405 |
| 2,370,828 | 3/1945 | Widmont | 10/162 R |
| 2,390,596 | 12/1945 | Larsen | 29/38 C |
| 2,415,037 | 1/1947 | Redmer | 269/57 |
| 2,941,424 | 6/1960 | Dixon | 74/814 |
| 3,150,439 | 9/1964 | Van Deberg | 29/38 C |
| 3,341,927 | 9/1967 | Grainger | 29/38 C |
| 3,492,681 | 2/1970 | Krueger | 10/11 R |
| 3,827,116 | 8/1974 | Carroll | 83/267 |

*Primary Examiner*—C.W. Lanham
*Assistant Examiner*—Gene P. Crosby
*Attorney, Agent, or Firm*—Haight, Hofeldt, Davis and Jambor

[57] ABSTRACT

This disclosure includes a die for forming metal piece parts and includes two progressive die sections which partially form metal piece parts and transfer same to a rotary die section which nest the parts and rotates same through a series of work stations for finishing operations.

9 Claims, 7 Drawing Figures

COMBINED ROTARY PROGRESSIVE DIE

BACKGROUND OF THE INVENTION

This invention relates to a die for forming and working metal piece parts. More particularly, it relates to a combination die in which a rotary die cooperates with two progressive die sections to permit complete forming of a metal piece part without a carrier strip.

One conventional method of forming metal piece parts from strip material is to feed that strip material through a progressive die. This feeding, however, requires that excess material, known as a carrier strip, be used either adjacent to or between the parts. This carrier strip guides the movement of the piece part from station to station within the die. In addition, pilot holes carried in the strip, permit accurate positioning of the piece part prior to the closing of the die.

This conventional die performs in an acceptable manner in those instances where the design of the piece part permits its complete formation just prior to its cut off from the carrier strip. Its disadvantage may be the requirement of the excess material.

However, when the piece part requires forming operations both in the direction of feed and in the direction perpendicular to the feed, difficulties arise. That piece part, to permit forming in both directions, must be sheared away from its carrier strip. As a result, it is believed to be standard practice to utilize either excess carrier strip material or two separate dies and presses to form such metal pieces. Under the latter method, a first progressive die is used to partially form the piece parts in one direction. Then, these partially formed parts are severed from the carrier strip, conveyed to a feeder bowl and fed into a second progressive die in the second direction.

To avoid multiple handling problems presented by the use of separate progressive dies, the instant invention utilizes, in one die unit, a progressive die and a rotary die. Examples of a rotary die known to the prior art are depicted in the following U.S. Pat. Nos. 3,827,116; 3,492,681; 3,285,134; 3,150,439; 3,081,655; 2,649,056; 2,415,037; 2,370,828 and 641,725.

SUMMARY OF THE INVENTION

To form such piece parts in a single press at a high rate of production, the instant invention includes two progressive die sections which cooperate with a single rotary die section to completely form the metal piece part in one press. Each progressive die section, arranged on opposite sides of the rotary die, accepts a strip of raw material fed from opposite directions. Each die then partially forms piece parts by bending the material in one direction — preferably perpendicular to the feeding axis. When partially formed, each strip of partially formed parts is fed directly into opposite sides of a rotary die for first severing the partially formed metal piece part and encapsulating same into a nest or insert of the carrousel. Then upon rotation of the carrousel and its inserts, the partially formed piece part is rotated to separate work forming stations positioned about one-half of the carrousel for subsequent operations. These subsequent operations may include bending of the piece part in the opposite direction (e.g. perpendicular to the original direction of feed), coining, punching, piercing, sizing and ejection of the finished work piece. With the use of this invention, two completed metal piece parts can be formed upon each stroke of the press.

Accordingly, it is an object of our invention to provide a die having one or more of the following and other advantages:

1. A cooperative arrangement between a progressive die section and a rotary die section which permits each of the edges of piece parts to be bent and formed in directions perpendicularly to one another;

2. An arrangement between two progressive die sections each cooperating with one-half of a rotary die to permit simultaneous formation of two metal piece parts upon each stroke of the press;

3. A cooperative arrangement between a progressive die which eliminates the need for a carrier strip material between the piece parts, and permits the formation of a complete, complex piece part without subsequent operations or the use of two or more separate presses;

4. A rotary die having a first shearing station for severing partially formed parts from one another and for properly positioning said parts within a cavity or nest of the rotary die;

5. A rotary die cooperating with two progressive dies to reliably produce metal piece parts having very small tolerances and at a high rate of production.

DESCRIPTION OF THE DRAWINGS

The manner in which these and other advantages are attained are described in the following specifications and drawings in which.

DETAILED DESCRIPTION

Figure 1:
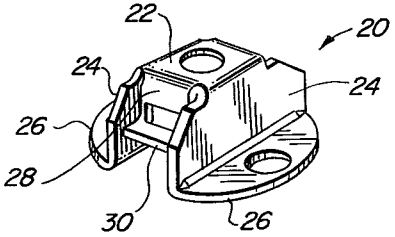
FIG. 1 is a perspective view of a typical metal piece part whose manufacture is facilitated by use of the present invention.

This invention is particularly adapted to form a piece part such as that depicted in FIG. 1. This part 20 has a rectangular base 22 with webs extending from each of its four sides. Two of these webs 24 are formed about the edges of the base which are parallel to the direction of feed of strip material within the press while the other two webs 28 are formed about the edges perpendicular to the direction of feed. As further shown in FIG. 1, flanges 26 and 30 extend outwardly from each of these webs. With such a configuration, each of the exterior edges of the piece part must be formed or bent about the base, thus requiring its severance from any carrier strip for complete fabrication.

Figure 3:
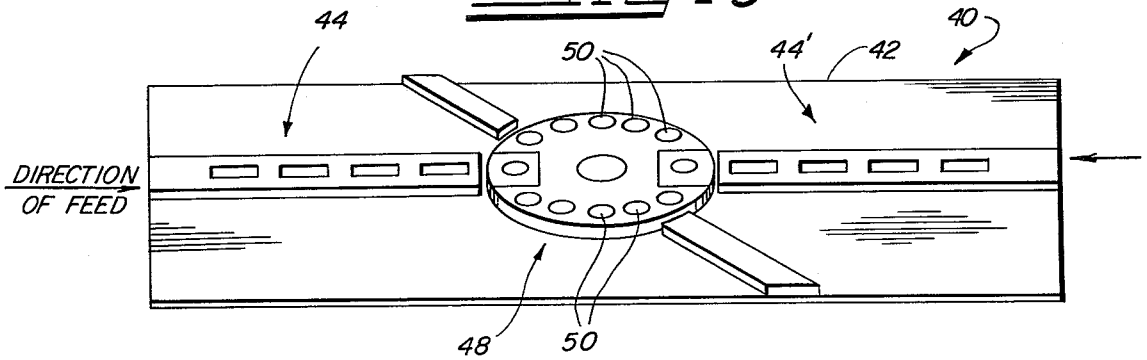
FIG. 3 is a symbolic view in perspective illustrating the feeding of two strips of stock material into each end of die towards a center rotary die.

According to this invention, such a piece part can be manufactured in a single die 40 whose lower die shoe 42 is illustrated symbolically in FIG. 3. This die shoe is provided with two separate progressive die sections 44, 44' which partially form material strips 46, 46', and feed semifinished parts to a rotary die 48. This die is formed with piece part receiving cavities 50 which receives two parts 20 simultaneously and rotates each part through six stations on one side of the rotary die. At the last station or at 150 degrees of rotation, two finished piece parts are ejected.

Figure 2:
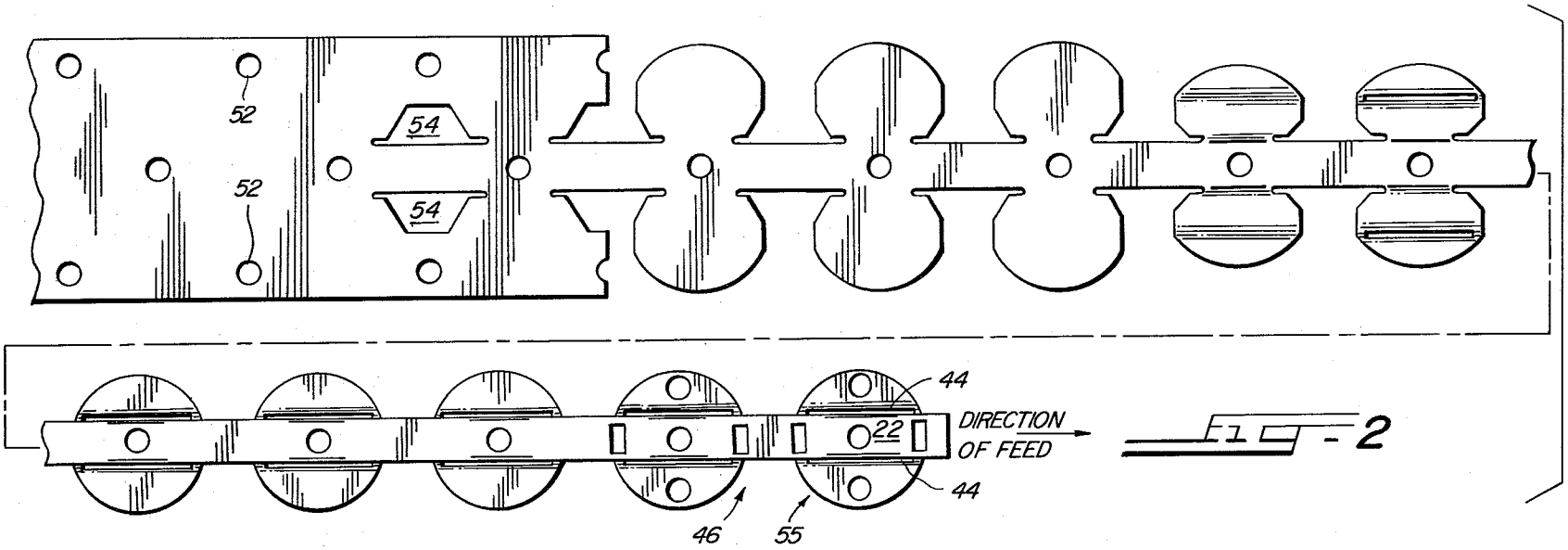
FIG. 2 is a plan view of the stock material depicting the results forming operations within the progressive die sections.

The details of each of the progressive dies 44, 44' are conventional. Such comprises tooling to form a partially formed piece part as shown in FIG. 2 from strip material 46. As the stock material is fed into the press and die, pilot apertures 52 are first formed. At a subsequent station, a portion of the excess material 54 is first removed by a punch (not shown). The strip 46 continues to be fed past forming sequential stations which bent the webs 24 upwardly from the base material 22, the piece part being formed in a position inverted from that depicted in FIG. 1. The design and detail of these stations and the forming tools, being well within the skill of the art, are omitted for purposes of clarity. Their structure is designed to size and form the piece part as the strip progresses to the rotary die section 48 at which point it takes the shape depicted at 55 in FIG. 2. Here, the webs 24 have been folded about the base edges perpendicular to the direction of feed and the flanges 26 have been completely formed. It should also be apparent that the web 28 and its flange cannot be formed without shearing the piece part away from the strip material — thus presenting a handling problem.

According to this invention, that handling problem is eliminated by shearing the partially formed piece part 20 directly into a nest or cavity 50 of the rotary die 48 for rotation through six forming stations which form the web 28 and flanges 30.

Figure 4:
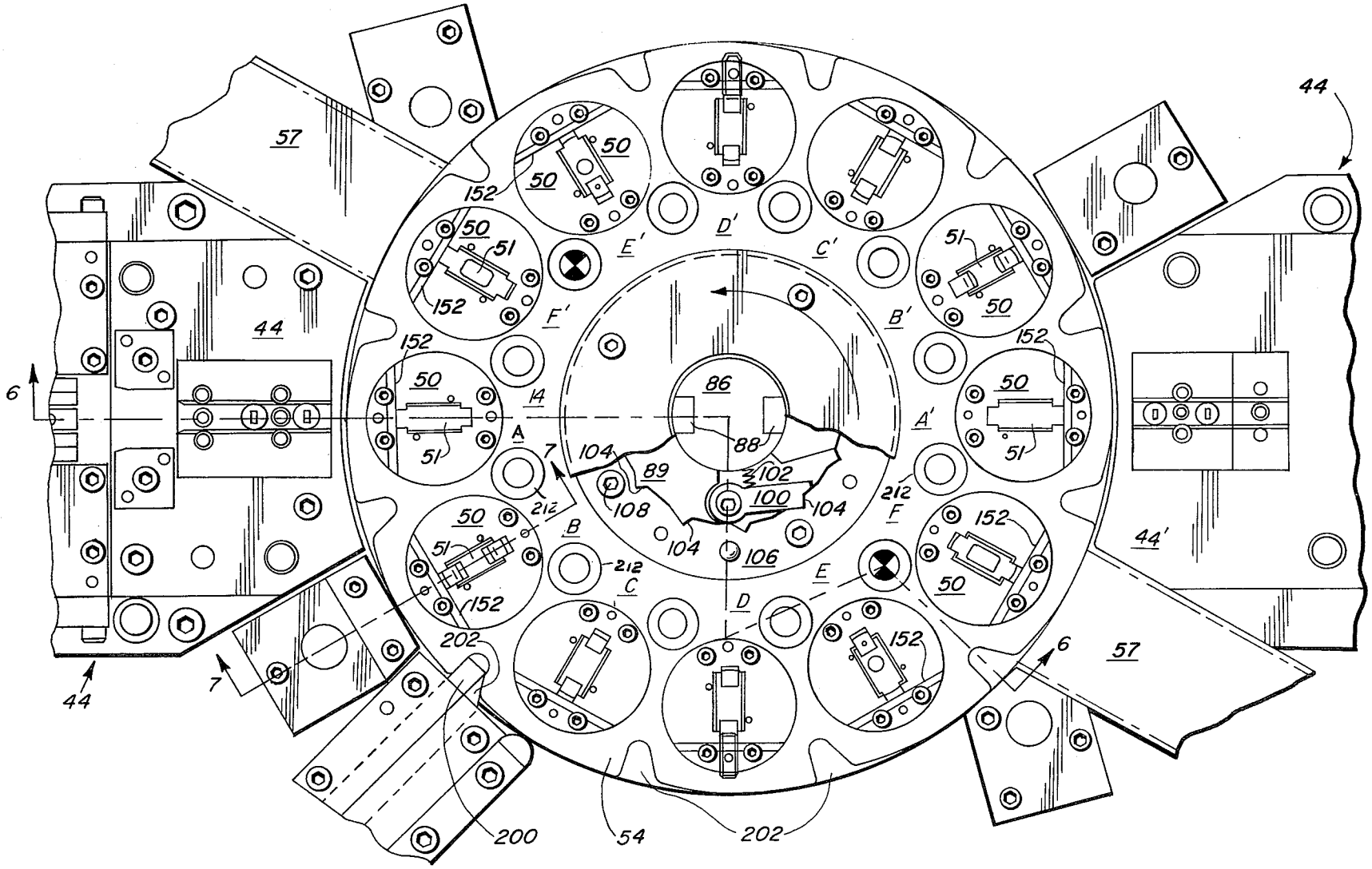
FIG. 4 is a plan view of a portion of the lower die which includes portions of the two progressive die sections and the rotary die section.
Figure 5:
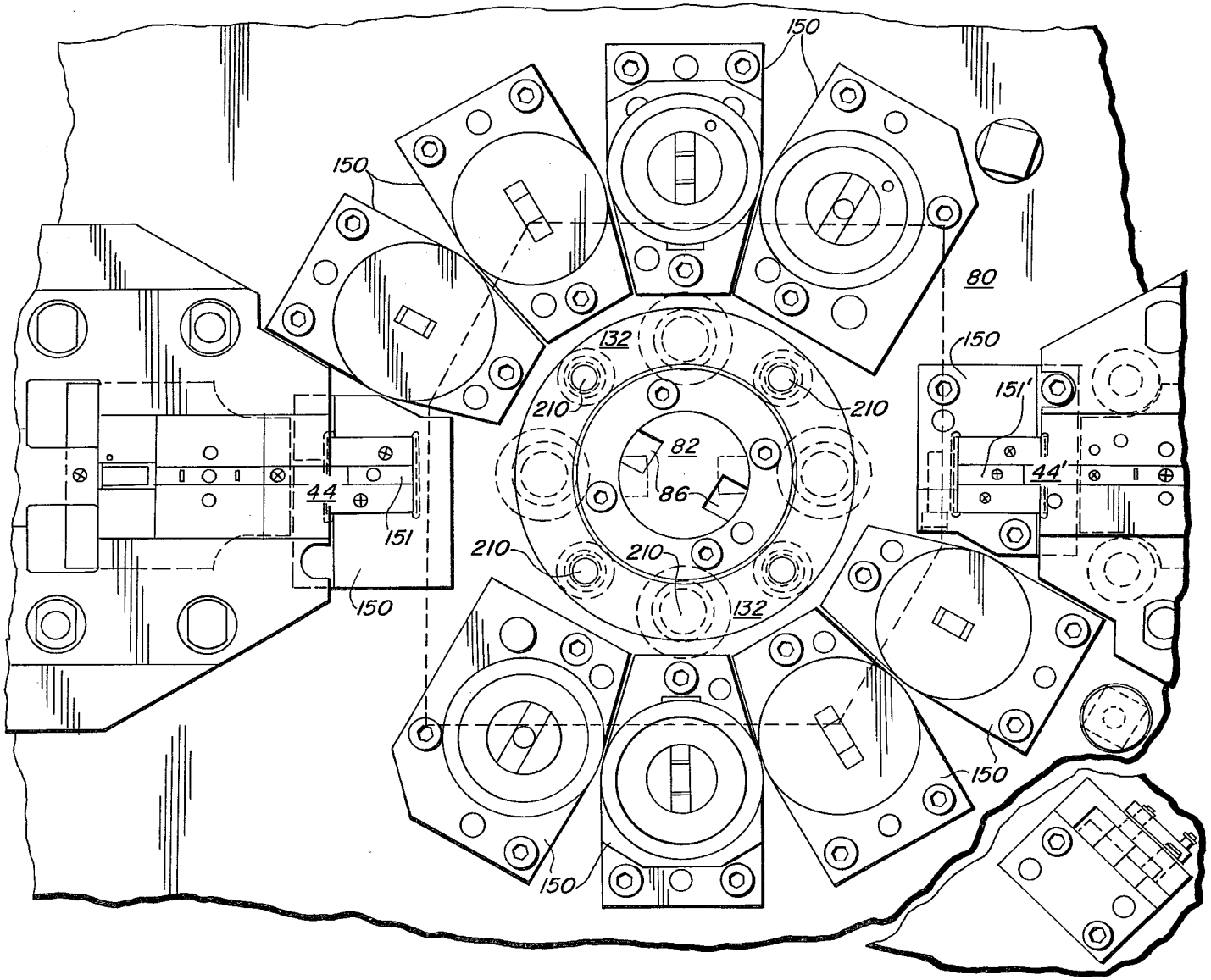
FIG. 5 is a plan veiw of a portion of the upper die depicting the tools, which in conjunction with those of the lower die perform the forming operations.
Figure 6:
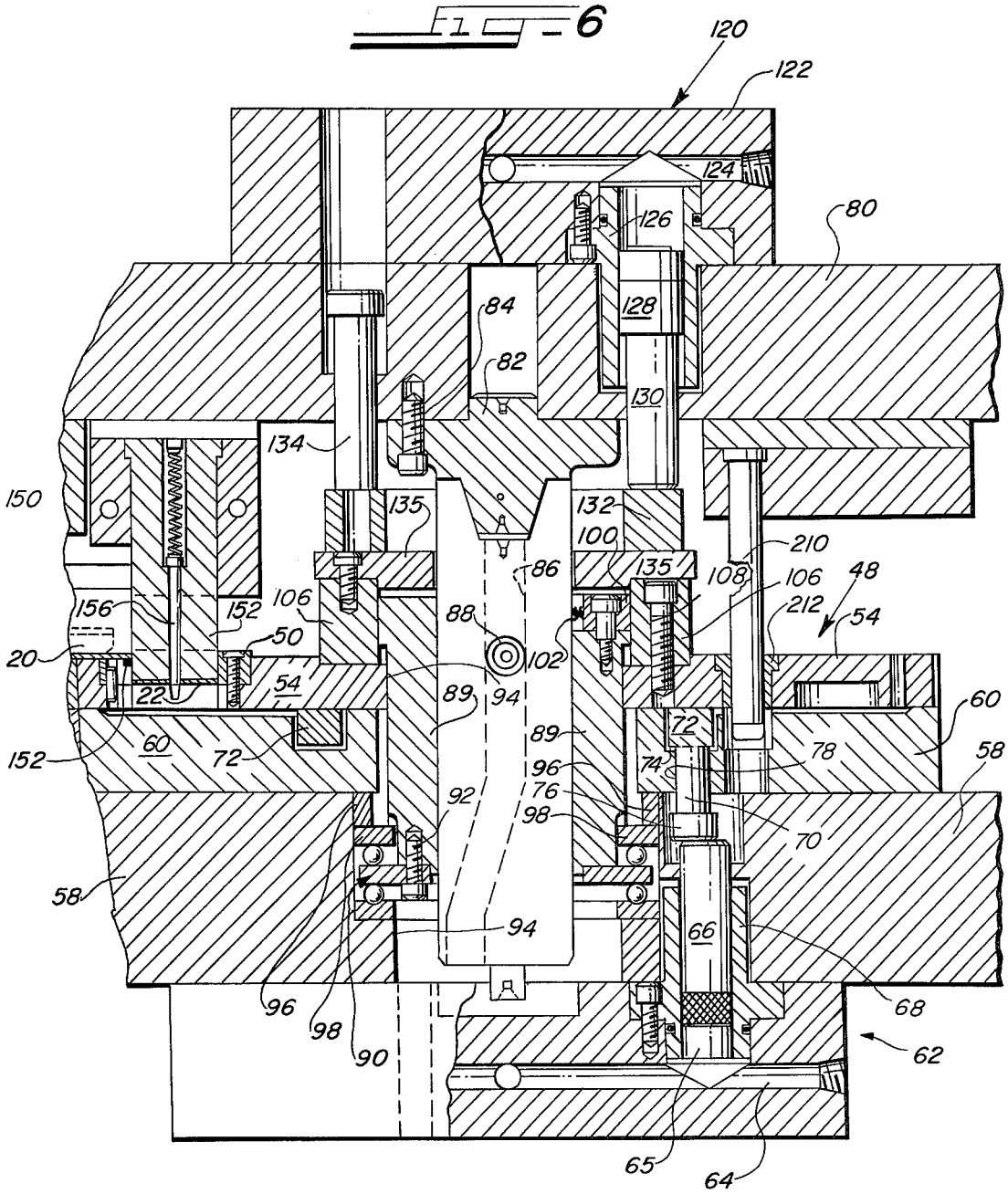
FIG. 6 is a side elevational view of the rotary die taken along the lines 6—6 of FIG. 4.

FIGS. 4–6 depict the necessary details of the progressive and rotary dies. Considering first the plan view of the lower die (FIG. 4), the two progressive dies 44, 44' are positioned to guide the strip material 46 and the partially formed parts 20 into inserts 50 having part receiving cavities 51, twelve of which are mounted in a rotary dial plate 54. This plate is mounted for intermittent counter-clockwise motion to carry the part 20 to six separate stations in which forming tools are affixed both above and below the dial plate 54. These tools coact with one another to perform a simple operation on the piece part. For the particular piece part shown in FIG. 1, these stations may include the shearing stations A, A'; perform stations B, B' for initially bending webs 28; forming stations C, C' for completing the formation of webs 28 and flanges 30, sizing stations D, D', piercing stations E, E', and finally ejecting stations F, F', where the two parts are simultaneously ejected into collection troughs 57. To the extent necessary the details of these individual stations will be subsequently discussed.

Means for rotating the dial plate through these stations is best depicted in FIG. 6. This dial plate 54 together with the two progressive dies are mounted on a lower die shoe 58, which, in turn, is supported by the bed (not shown) of a press. Affixed on the top of the die shoe 58 by bolts (not shown) is the dial base 60 which carries selected forming tools as subsequently illustrated in FIG. 7. Since these forming tools may extend upwardly beyond the dial base 60, the rotary die plate is mounted for limited vertical movement which occurs prior to rotation.

This movement is effected by hydraulic means 62 commonly referred to as a diedraulic unit. Such includes a sourse of fluid (not shown) which directs fluid pressure through conduits 64 and 65 in a block against a plurality of pistons 66 equally spaced about the rotary dial plate 56. With the pistons urged vertically upward within a cylindrical chamber insert 68, they act against piston bolts 70 which extend against a pressure ring 72 mounted within a groove 74 in the dial base 60. Upward movement is limited by the head 76 of the bolts 70 which, as shown, are unable to pass through the apertures 78 of the dial base.

Accordingly, if the upper die shoe 80 is raised by the press, downward pressure of the upper shoe is removed from the rotary dial plate and pressure from diedraulic unit 62 raises the dial plate 54 above any tools carried by the rotary dial base 60. The dial plate is then free to rotate upon further vertical movement of the upper shoe 80. To effect this rotation, the upper shoe 80 carries a vertical drive shaft 82 bolted thereto by a plurality of bolts 84. Formed upon opposite sides of this shaft 82 are two cam grooves 86 in which are positioned two roller bearings 88 affixed to the rotary dial plate 56 in the following manner. A collar 89, which supports bearings 88, is journaled about the shaft 82. At the lower end of collar 89 is a bearing assembly 90 which is affixed by a plurality of bolts 92 to the bottom end of the collar 89. The collar 89 is then fixed within the aperture 94 by an annular spacer 96 interposed between the upper race 98 of bearing assembly 90 and the fixed rotary dial base 60.

Thus, as the upper die shoe 80 and shaft 82 are sufficiently raised to permit elevation of rotary die plate 56, grooves 86 will force the bearings 88 and collar 89 to rotate 30°. As shown in FIGS. 4 and 6, activating arms 100 are bolted to the top of collar 89 and are spring biased outwardly of shaft 86 by a spring 102. The extended ends of these arms then engage teeth 104 of an annular camming plate 106 which, through bolts 108, is constrained for rotation of the dial plate 56.

Referring again to FIG. 6, the upper die shoe is also provided with a diedraulic unit 120 which includes a manifold housing 122 having conduit 124 communicating fluid pressure to a plurality of chamber inserts 126. Each of these inserts carry a piston 128 and ram 130 extending downwardly therefrom to act upon an annular pressure ring 132 on the downward stroke of die shoe 80. This pressure ring 132 has, through bolts 134, a lost motion connection with the upper die shoe 80. It should be noted that pistons 128 of diedraulic unit 120 have a greater area than that of piston 66 of the diedraulic unit 62.

With this background, movement of the rotary plate 56 can be understood. Assuming the upper die shoe 80 has just completed its downward stroke, it is then raised by the press to remove pressure from the pressure ring 132 and annular pad 135. Such permits elevation of the rotary plate 56 above any tools carried by dial base 60 under the pressure of the diedraulic unit 62. As the upper shoe 80 is raised further, the grooves 86 will then cam the bearings 88 to rotate collar 89 approximately 30°. Rotation of the collar, acting through the actuating arms 100, engage teeth 104 of cam plate 106 to rotate both the cam plate 106 and the rotary dial plate 56. Subsequent to rotation, the upper shoe is then driven downward to act upon the piece parts at each of the stations A through F. Upon downward movement, the upper diedraulic unit 120 acts upon the pressure ring 132 and pad 135 to fully seat the rotary plate 54. At this point, each insert 50 has been rotated to the next station for a subsequent operation. In addition, each progressive die had fed a partially formed piece part into stations A, A' while two finished piece parts have been ejected from stations F, Fi. Now, subsequent to full seating, the upper die shoe continues downward movement such that the tool elements of the upper shoe 80 will coact with those of the lower die shoe 58.

Referring again to FIG. 6 which depicts station A, a partially formed piece part will have been reciprocated above an insert 50 in rotary die 48. Mounted by bolts (not shown) above station A on die shoe 80, is a tool carrier 150 which carries a punch 151 which, acting in conjunction with a carbide insert 152 of cavity 50, will shear partially formed piece part 20 from the strip 46. A spring biased pilot pin 156 mounted within punch 151 as shown will enter the aperture of base 22 to insure its proper positioning prior to shearing. This is the only operation which occurs at stations A, A'.

The remaining stations B, B' – F, F' may take various shapes to perform various operations upon the piece part whose final configuration will determine the tools to be used. However, as an illustration, the tools of stations B, B' are depicted in FIG. 7.

Figure 7:
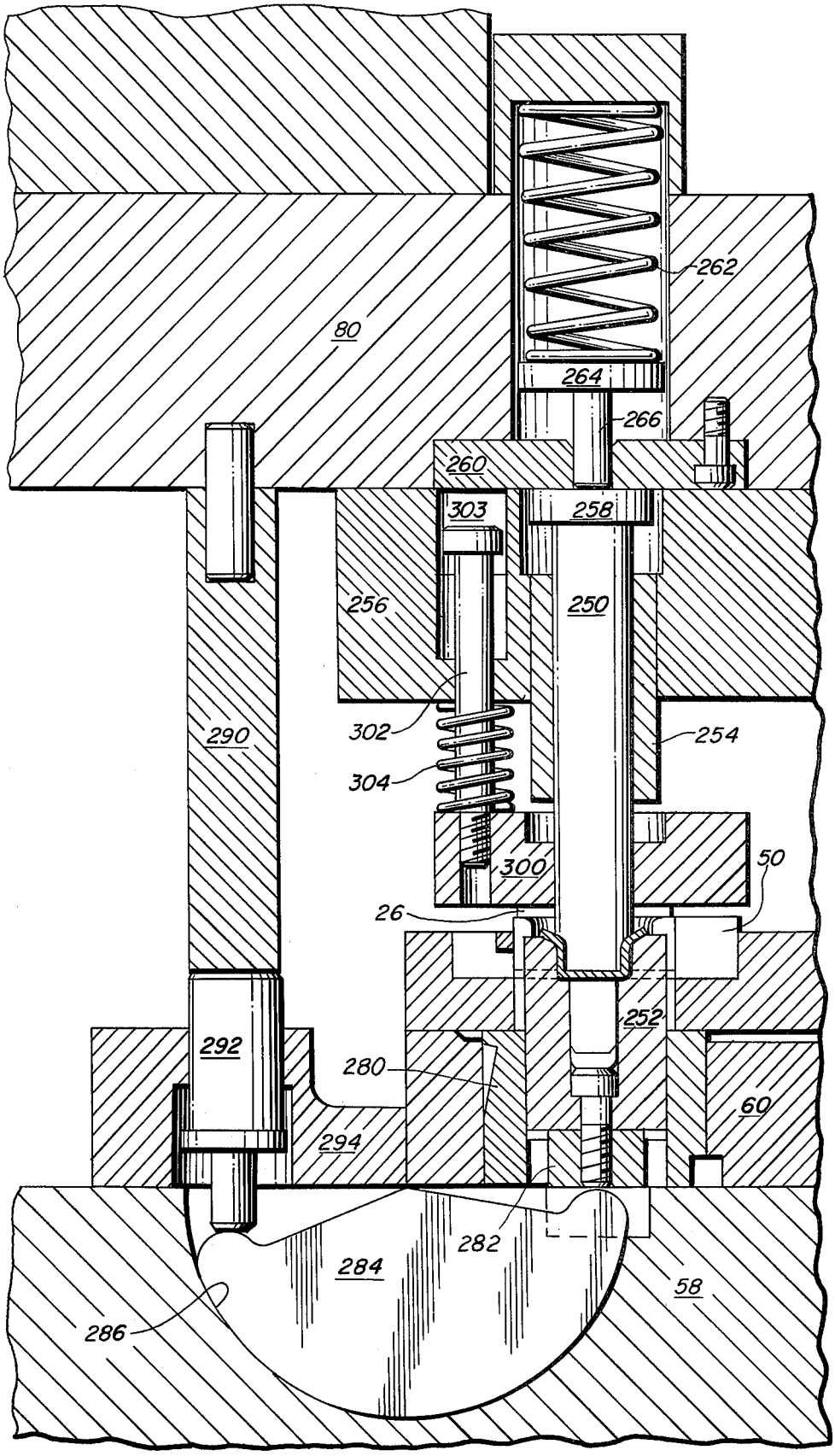
FIG. 7 is a side elevational view in section taken along the lines 6—6 of FIG. 4 illustrating one set of coacting tool elements of the rotary section of the die.

At this station the webs 28 and flanges 30 are partially formed from the material extending from base 22 (see dotted lines, FIG. 7). This forming action is effected by an upper forming tool 250 carried by the upper die shoe 80 and a lower forming tool 252 mounted in the lower die shoe.

This upper tool 250 is mounted for reciprocal movement within a guide sleeve 254 which is carried by a tool holder 256 attached to the upper die shoe. A head 258 of the tool (in the closed position of the die) abuts a hardened insert 260 forcing the tool into piece part 20. Prior to reaching the closed position, a compression spring 262 mounted in die shoe 80 acts upon a piston 264 to extend the stem 266 through an aperture in insert 260 and drives the tool 250 downward. Thus, the tool 250 may fully seat upon piece part 20 prior to complete closing of the mold, and engagement between tool 250 and insert 26.

With the upper tool seated, a lower forming tool 252 can then be urged upward to partially bend the webs 28 and flanges 30 upwardly. To accomplish this, the lower tool 252 is also mounted for vertical, reciprocal action. It is mounted within an insert 280 of lower die shoe 60. At the lower end of tool 252 is mounted a hardened cross bar 282 which receives a vertical upward thrust from a cam 284 mounted for rotational motion in a semicircular shaped slot 286 milled within the lower die shoe 60. Not shown in the drawings are two compression springs acting on opposite sides of the bar 282 to urge tool 252 downwardly upon opening of the die.

The cam 284 is caused to rotate by a cam plunger 290 mounted on the upper die shoe 80. Upon closing of the die, this plunger 290 strikes a lower plunger 292 which is mounted for reciprocal action within a retainer 294. The downward force of plunger 292 is, in turn, transmitted to one side of the cam 284 causing it to frictionally rotate within slot 286 driving the other side of the cam upward to vertically reciprocate the lower forming member 252 and bend to the webs 28 and flanges 30 about upper tool 250 as shown in the drawing.

FIG. 7 also depicts the stripper block 300 which, upon die closing engages the flanges 26 of piece part 20, and applies a downward force thereto until the tool 250 can be retracted. This block is mounted upon the upper die shoe 80 by a bolt 302 reciprocating within an aperture 303 of tool holder 256. A spring 304 interposed between block 256 and stripper plate 300 applies the downward force upon piece part 20 until the free play of bolt 302 within aperture 303 is eliminated by vertical movement of die shoe 80.

While the tools of FIG. 7 are illustrative, those skilled in the art will appreciate that various other tools may be employed as required by the piece part design. While not specifically described, the die would include additional parts such as additional diedraulic pistons as may be needed to balance the rotary die. Too, as with conventional dies, stripper plates may be carried by the upper die shoe to insure that both piece parts in rotary die and the carrier 46 are stripped from the tools of the upper die shoe 80 as it is raised. Finally, numerous leader pins may be used to insure proper alignment between the upper and lower die shoes. Also, as shown in FIG. 4, a standard locating bar 200 having timed reciprocation with notches 202 of rotary die may aid in initially positioning the unit in proper location prior to locking action of locating pins 210 of the upper shoe 80 engaging bushings 212 of the dial plate 54. Additions such as safety switches and various modifications, including proper tool selection, will be apparent to those skilled in the art.

I claim:

1. Progressive rotary die unit for forming metal piece parts comprising:

(a) Upper and lower die shoes adapted to be mounted in a press for relative vertical reciprocation;

(b) Said die shoes having a plurality of stations of coacting tool sets;

(c) At least one group of said stations defining a progressive die for receiving a strip of material and for performing a series of metal working operations on said strip to define partially formed piece parts;

(d) A second group of said stations being arranged about a circumference of a circle;

(e) A dial plate mounted on said lower die shoe and having cavities therein, said cavities coacting with tools of said upper die shoe to sever partially formed piece parts from said strip and for nesting said parts; and (f) Means for rotating said partially formed piece parts through said second group of stations upon relative reciprocation of said die.

2. An apparatus as recited in claim 1 in which a separate group of stations is provided on each side of said second group of stations to define two progressive dies which simultaneously feed two piece-parts to said rotary dial plate at positions 180° apart.

3. An apparatus as recited in claim 1 in which:

(a) At least one of said coacting tools mounted on said lower die shoe are mounted for vertical reciprocation relative to said lower shoe; and (b) Said dial plate is mounted for a vertical reciprocation relative to said lower die shoe for raising said dial plate above said tools of said lower die shoe prior to rotation.

4. An apparatus as recited in claim 2 in which said upper and lower dies carry coacting cam means for reciprocating said tool mounted for reciprocation relative to said lower die shoe.

5. A die for simultaneously forming two identical piece parts, said die comprising:

(a) Upper and lower die shoes adapted to be mounted in a press;

(b) Said die shoes having a plurality of stations mounting coacting forming tools;

(c) A first set of said stations defining a progressive die for receiving and partially forming piece parts from strip material;

(d) A second set of said stations defining tools of a rotary die;

(e) A dial plate mounted for rotational motion and having cavities for receiving partially formed piece parts from said first set of stations; and (f) Means for rotating said dial plate through said second set of stations for effecting additional forming operations.

6. An apparatus as receited in claim 5 in which:

(a) Said tools of said second section mounted on said lower die shoe are vertically reciprocal; and (b) Means are provided for vertically reciprocating said dial plate above said tools of said section prior to effecting rotation of said dial plate.

7. A die for forming metal piece parts comprising:

(a) Upper and lower die shoes adapted to be mounted in a press;

(b) Said die shoes having a plurality of coacting tool forming sets, arranged to define die sections;

(c) Said die sections including a progressive die section for receiving and partially forming piece parts of a strip material; and a rotary die section for receiving said partially formed parts in nested cavities for rotating same through subsequent tool forming sets.

8. An apparatus as receited in claim 7 in which a progressive die is mounted on opposite sides of said rotary die.

9. An apparatus as recited in claim 7 in which:

(a) A progressive die is mounted on opposite sides of said rotary die; and (b) Cavities positoned 180° apart to receive partially formed parts and rotate said parts through a plurality of coacting tool forming sets.

* * * * *